United States Patent [19]

Offutt

[11] Patent Number: 4,715,600

[45] Date of Patent: Dec. 29, 1987

[54] DOOR MOUNTED, HEIGHT ADJUSTABLE BASKETBALL BACKBOARD AND RIM

[75] Inventor: James C. Offutt, Peoria, Ill.

[73] Assignee: Rimball, Inc., Peoria, Ill.

[21] Appl. No.: 844,986

[22] Filed: Mar. 27, 1986

[51] Int. Cl.[4] ..... A63B 63/08

[52] U.S. Cl. ..... 273/1.5 R; 211/86; 248/225.31

[58] Field of Search ..... 273/1.5 R, 1.5 A; 248/225.31, 231.6; 211/86

[56] References Cited

U.S. PATENT DOCUMENTS

| | | | |
|---|---|---|---|
| Re. 20,898 | 10/1938 | Schabinger . | |
| 2,085,206 | 6/1936 | Holmdahl . | |
| 2,192,430 | 8/1938 | Branner . | |
| 2,208,358 | 7/1940 | Chandler | 248/225.31 X |
| 2,270,796 | 1/1942 | Hauser | 211/86 |
| 2,473,908 | 8/1948 | Rubin . | |
| 2,508,527 | 5/1950 | Martin et al. | 248/225.31 X |
| 2,512,417 | 6/1950 | Cook . | |
| 2,517,463 | 4/1950 | Cobb . | |
| 2,889,149 | 6/1959 | Williams | 273/1.5 R X |
| 2,925,916 | 2/1960 | Pollock | 211/86 |
| 3,669,450 | 6/1972 | Mason . | |
| 3,776,549 | 12/1973 | Ganis . | |
| 3,814,359 | 6/1974 | Powell . | |
| 4,005,860 | 2/1977 | Ebstein et al. . | |
| 4,036,494 | 7/1977 | Hayes . | |
| 4,183,522 | 1/1980 | Killen . | |
| 4,468,027 | 8/1984 | Pangburn . | |

FOREIGN PATENT DOCUMENTS

| | | | |
|---|---|---|---|
| 2383581 | 11/1978 | France | 211/86 |

*Primary Examiner*—Paul E. Shapiro

*Attorney, Agent, or Firm*—Allegretti, Newitt, Witcoff & McAndrews, Ltd.

[57] ABSTRACT

A basketball game for mounting on a conventional door, in which a backboard and rim are height adjustable relative to the face of the door. A pair of U-shaped brackets receive the top and bottom edge of the door and a vertical pole is mounted between the brackets. The brackets are tightenable relative to one another for rigidly holding the apparatus to the door. The one U-shaped bracket located at the top edge of the door includes a relatively thin L-shaped metal member and a relatively thick front member. The L-shaped member has a first leg for seating against the backside of the door and a second leg for seating against the top edge of the door. The thick front member has a first face for seating against front face of the door and a second top face for abutting a portion of the second leg of the L-shaped member. A screw secures the second leg to the second top face of the front member.

3 Claims, 3 Drawing Figures

DOOR MOUNTED, HEIGHT ADJUSTABLE BASKETBALL BACKBOARD AND RIM

BACKGROUND OF THE INVENTION

The invention relates to a basketball goal for mounting on a conventional door and more particularly relates to a door basketball goal which is adjustable in height with respect to the floor.

Heretofore, basketball goal apparatus include brackets or the like which permit a basketball goal to be mounted to the top of a conventional door. See, for example, U.S. Pat. No. 2,512,417, issued to C. J. Cook on June 20, 1950. Such brackets generally include a U-shaped channel which permits the bracket to be merely hooked over the upper edge of the door and then the door is closed whereupon the door jamb above the door retains the bracket in position.

However, the force of the ball being thrown against the rim causes the bracket to vibrate and jostle, often marring the door. In order to prevent the movement of the bracket relative to the door, screws, nails or tracks may be driven through holes in the bracket securing the bracket directly to the door. See, for example, U.S. Pat. No. 4,468,027, issued to C. A. Pangburn on Aug. 28, 1984.

It would be highly advantageous to have a basketball bracket for mounting on the upper edge of a door which may be rigidly secured to the door in such a manner as to prevent vibrational movements and the like. This is particularly true where the thickness of the door varies.

Also, such basketball goals which are secureable to a door do not permit height adjustability of the goal with respect to the floor. This is particularly important so as to permit children of all ages to utilize the basketball game. Adjusting the height of the basketball rim to the center of the door would permit young children and toddlers to play the game. As the child grows in height, the basketball rim may be adjusted across the face of the door.

It is therefore an object of the present invention to provide a basketball goal which is attachable to a conventional door in a firmly mounted manner which prohibits excessive vibration during play of the game.

It is yet another object of the present invention to provide a basketball backboard assembly for mounting to a door which permits height adjustability of the goal rim with respect to the floor.

SUMMARY OF THE INVENTION

These and other objects of the invention are achieved in a basketball game apparatus comprising a first U-shaped bracket for receiving the upper edge of a conventional door and a second U-shaped bracket for receiving the lower edge of the door. A vertical pole is secured between said first and second U-shaped brackets and permits height adjustable mounting of a backboard and rim assembly. A tightening structure is operable for pulling the first and second brackets towards one another, clamping the door tightly therebetween in order to rigidly dispose the vertical pole relative to the door.

DESCRIPTION OF THE PREFERRED EMBODIMENT

Figure 1:
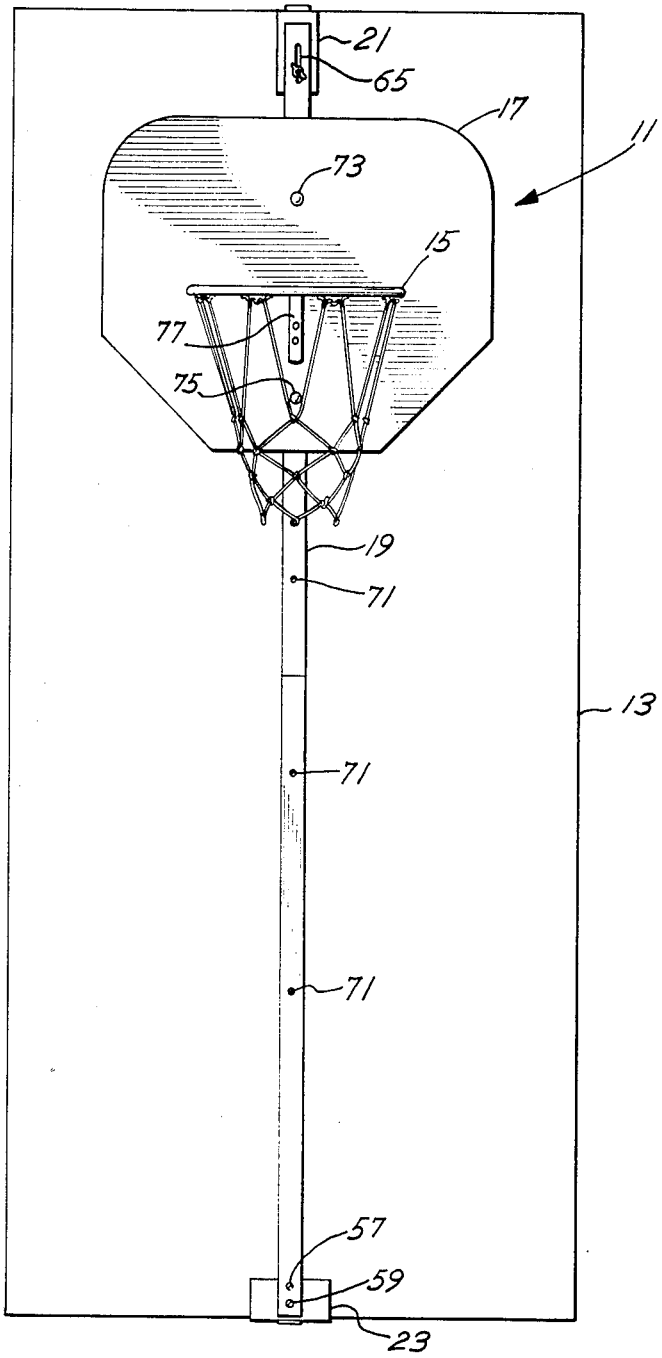
FIG. 1 is a front view of a preferred embodiment of a basketball game apparatus.

Referring to FIG. 1, a basketball game 11 is secured to a conventional door 13. Basbetball game 11 includes a goal rim 15 which is mounted to a backboard 17. Backboard 17 is secured firmly to a vertical pole 19 which is held firmly to the door by an upper bracket 21 and a lower bracket 23.

Figure 2:
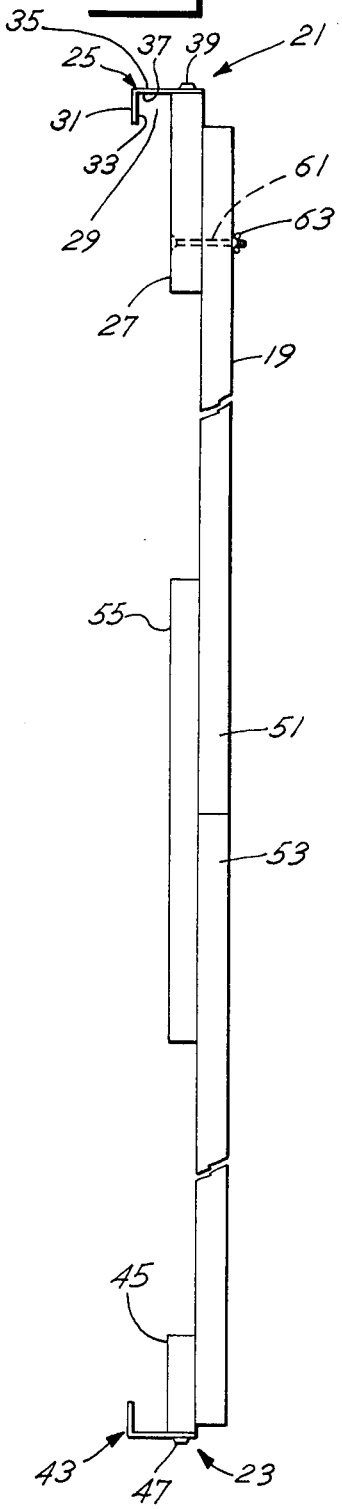
FIG. 2 is a side view of the first and second U-shaped brackets and vertical pole of the basketball game apparatus of FIG. 1.

As shown in FIG. 2, bracket 21 is generally U-shaped in configuration, being constructed from an L-shaped member 25 and a support member 27. L-shaped member 25 is formed from a relatively thin piece of metal having a thickness for permitting door 13 to close with L-shaped member 25 between the upper edge of the door and the lower edge of the door jamb (not shown).

Bracket 21 includes a U-shaped channel 29 of a size for receiving the upper edge of door 13. L-shaped member 25 includes a first leg 31, having a flat inside surface 33 for seating against the backet side of the door. A second leg 35 includes a flat inside surface 37 for seating against the top edge of the door. As will suggest itself, L-shaped member 25 may be formed from a single, flat piece of metal which is bent to form legs 31, 35.

Figure 3:
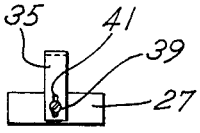
FIG. 3 is a top view of the first U-shaped bracket of the basketball game apparatus of FIG. 1.

As shown in FIG. 3, a screw 39 passes through an opening 41 formed in the second leg 35, passing into front support member 27. Support member 27 may be formed from wood and screw 39 may be a conventional wood screw. The head of screw 39 is of a wider diameter than the width of slot 41 permitting screw tightening of metal leg 35 against support member 27. Slot 41 provides a longitudinal opening along the longitudinal axis of leg 35 for permitting adjustability of the width of U-shaped channel 29. This provides adjustability of the apparatus to doors of various thicknesses.

Similarly, bracket 23 is formed from a second L-shaped member 43 and a second front support member 45. A screw 47 serves to secure L-shaped member 43 to support member 45. A slot (not shown) similar to slot 41 may be used in member 43.

Pole 19 may be formed from two separate wooden rectangular shaped members 51, 53. A third front support member 55 is positioned behind the abutting edges of members 51, 53 as shown in FIG. 2. Support member 55 may be formed of wood and screw-secured to members 51, 53, aligning and holding members 51, 53 relative to one another. Referring to FIG. 2, support members 27, 45, 55 are of like thickness for supporting vertical pole 19 out from door 13 by a fixed distance.

As shown in FIG. 1, bracket 23 is screw-secured to the lower end of vertical pole 19 by a pair of wood screws 57, 59. Bracket 21 is secured to the upper end of vertical pole 19 by a screw 61 and wing nut 63, as shown in FIG. 2. The upper end of vertical pole 19 includes a slot 65 (FIG. 1) formed along the longitudinal axis of vertical pole 19. Screw 61 is disposed in a cylindrical hole in a support member 27 for retaining screw 61 in a fixed position relative to support member 27.

Slot 65 permits the vertical adjustment of pole 19 relative to bracket 21. Slot 65, screw 61 and wing nut 63 permit brackets 21, 23 to be pulled toward one another and held in position via vertical pole 19 and by the tightening of wing nut 63. This serves to clamp the door tightly between brackets 21, 23 which hold the brackets firmly in position on door 13 without the need to screw the brackets directly into the door.

As shown in FIG. 1, vertical pole 19 includes a plurality of holes 71 for securement of backboard 17 to vertical pole 19. As shown in FIG. 1, backboard 17 is secured by a pair of screws 73, 75 which pass through holes 71 (not shown) in vertical pole 19. Backboard 17 may be adjusted in height by the removing screws 73, 75, sliding the backboard downwardly and aligning the backboard with a different set of holes 71 for resecurement using screws 73, 75. Screws 73, 75 may be conventional with a nut screw at the backside of vertical pole 19 onto screw 73, 75.

Rim 15 includes a cylindrical, depending shaft (not shown) which is received in a hollow support tube 77, similar to that described in copending U.S. patent application Ser. No. 761,050, filed July 31, 1985, by the same inventor named in the present application. Hollow tube 77 may be secured to backboard 17 by conventional screws or the like. As will suggest itself, rim 15 may be secured to backboard 17 in a conventional way.

It is to be understood, of course, that the foregoing describes a preferred embodiment of the present invention and that modifications may be made therein without departing from the spirit or scope of the present invention as set forth in the appended claims.

What is claimed:

1. A basketball game apparatus comprising:

a first U-shaped bracket member having a U-shaped channel of a size for receiving the upper edge of a conventional door;

a second U-shaped bracket having a channel of a size for receiving the lower edge of the door;

a vertical pole of length shorter than the height of the door and having a first end and a second end, said first end being secured to said first bracket and said second end being secured to said second bracket for securing said pole in a substantially vertical relationship with respect to the outer face of the door;

tightening means for pulling said first and second bracket toward one another for clamping the door tightly therebetween in order to rigidly dispose said pole relative to the door; and a backboard and basketball rim assembly adjustably mountable to various vertical positions along said pole;

said first U-shaped member including a relatively thin L-shaped metal member and a relatively thick front member, said L-shaped member having a first leg for seating against the backside of the door and a second leg for seating against the top edge of the door, said thick front member having a first face for seating against the front face of the door and a second top face for abutting a portion of said second leg of said L-shaped member; and securement means for securing said second leg to said second top face of said front member.

2. A backetball game apparatus according to claim 1 wherein said vertical pole includes means for adjusting the vertical position at which said vertical pole is secured to said first bracket.

3. A basketball game apparatus according to claim 2 wherein said vertical pole includes a vertically extending slot and wherein said game apparatus further includes a screw extending through said slot from said first bracket member; and a tightening means secured to said screw on the outside of vertical pole for clamping said pole between said first bracket member and said tightening means.

* * * * *